United States Patent [19]

Doshi et al.

[11] 4,330,491

[45] May 18, 1982

[54] COOLING TOWER WATER DISTRIBUTION PIPE AND SUSPENSION SYSTEM THEREFOR

[75] Inventors: Mahendra F. Doshi; Martin V. Gruber; Frederick R. Steinlein, all of Tampa, Fla.

[73] Assignee: Zurn Industries, Erie, Pa.

[21] Appl. No.: 194,966

[22] Filed: Oct. 8, 1980

[51] Int. Cl.[3] ..... B01F 3/04

[52] U.S. Cl. ..... 261/111; 138/107; 138/172; 248/58; 248/62; 261/DIG. 11

[58] Field of Search ..... 138/107, 109, 172, DIG. 2; 248/58, 61, 62; 261/110, 111, DIG. 11

[56] References Cited

U.S. PATENT DOCUMENTS

| | | | |
|---|---|---|---|
| 803,925 | 11/1905 | Ohde | 261/DIG. 11 |
| 3,202,184 | 8/1965 | Godshalk | 138/172 |
| 3,208,534 | 9/1965 | Kazarian | 261/DIG. 11 |
| 3,370,815 | 2/1968 | Opperthauser | 138/107 X |
| 3,424,442 | 1/1969 | Greenfield | 261/DIG. 11 |
| 3,457,963 | 7/1969 | Hardwick | 138/172 |
| 3,709,754 | 1/1973 | Medler | 138/172 X |
| 3,860,043 | 1/1975 | Kutnyak et al. | 138/172 X |
| 3,965,938 | 6/1976 | Baverle et al. | 138/107 |
| 4,101,103 | 7/1978 | Mooney et al. | 248/62 X |
| 4,134,563 | 1/1979 | Pollono | 138/107 X |

FOREIGN PATENT DOCUMENTS

| | | | |
|---|---|---|---|
| 52-3719 | 1/1977 | Japan | 138/172 |

*Primary Examiner*—Richard L. Chiesa

*Attorney, Agent, or Firm*—Webb, Burden, Robinson & Webb

[57] ABSTRACT

The distribution pipe which is horizontally mounted includes longitudinal reinforcement ribs formed of an increased wall thickness and extending substantially the length of the pipe preferably along the interior surface thereof. One such rib extends along the top of the pipe and preferably two ribs extend in parallel and spaced relationship along the bottom of the pipe. The pipe is formed of a polyester resin having fiberglass reinforcement extending longitudinally throughout the wall and ribs. External stiffener rings are positioned on the pipe at spaced intervals defined by support locations and the pipe is suspended from concrete beams by cable extending about the pipe and beams. The cable is connected above the beams and forms loops below the beam, which loops extend about the external ring stiffeners.

3 Claims, 4 Drawing Figures

COOLING TOWER WATER DISTRIBUTION PIPE AND SUSPENSION SYSTEM THEREFOR

FIELD OF THE INVENTION

Our invention relates to a water distribution system for cooling towers and, more particularly, to the distribution pipe and suspension system therefor for a counterflow natural or induced draft mechanical cooling tower.

DESCRIPTION OF THE PRIOR ART

Natural or induced draft cooling towers of the counterflow type commonly include a hyperbolic outer shell or circular tower, respectively with an air near the bottom, an air-liquid contact fill section positioned in the shell intermediate the upper and lower ends thereof, a pipe distribution system above the fill section for distributing water through appropriate spray nozzles on the fill as the air rises therethrough in counterflow relationship and a mist elimination system above the pipe distribution system. Heretofore, the distribution pipe has generally been an asbestos cement composition supported on concrete beams on 13 foot centers. While such systems have worked satisfactorily, there remains a need for an improved system which provides more open area for air to pass through and which eliminates asbestos as one of the compositional ingredients of the pipe.

Fiberglass reinforced pipe and particularly fiberglass reinforced polyester pipe has been used commercially, but normally to transport liquids under high pressure over continuous or very short span supports. As a result, this type of pipe has been manufactured with thick walls and the continuous glass fibers are located anywhere from a 0° to 45° angle from a radial plane through the pipe. These fiberglass reinforced polyester pipes have been manufactured with a wall thickness of a quarter of an inch to two inches to accommodate the high pressures.

SUMMARY OF THE INVENTION

We have found that we can replace the present asbestos cement pipe with a thin walled fiberglass reinforced polyester pipe which is designed to have the structural characteristics of a beam rather than a pipe. As a result, the pipe may be supported on a much longer span thereby substantially increasing the open area for air to pass therethrough. At the same time we are able to substantially reduce the wall thickness thereby reducing the weight and ease of assembling these pipes in the cooling tower. We are able to provide a thin walled fiberglass reinforced polyester pipe which functions as a beam and is capable of handling on the order of 0 to 2 psi water pressure on the largest possible span to minimize air blockage area. In addition, we suspend our pipe from the concrete beam supports rather than rest the pipe on the supports as has been done in the past. This, in combination with the longer spans, provides up to 23% more open area for air passage.

We provide a distribution pipe formed of fiberglass reinforced polyester having a longitudinal reinforcing integral rib formed of an increased wall thickness extenting preferably along the interior surface of the pipe throughout its length. With the pipe positioned in a horizontal position, one of the ribs is positioned along the pipe top and preferably two ribs are positioned in parallel and spaced relationship along the pipe bottom.

External ring stiffeners are positioned about the pipe and spaced at the intervals defined by the structural supports. The suspension system extends about the supports and is formed of cables connected above the supports and forming loops below the supports, which loops engage the external ring stiffeners so that the pipe is supported through suspension to the concrete beams. Bearing pads are employed between the concrete support beams and pipe. The pipe normally has an end cap at one end and is secured within a water trough at its opposite end so as to be gravity fed thereby. A number of pipe may be coupled in end to end relationship.

DESCRIPTION OF THE PREFERRED EMBODIMENTS

The pipe suspension system, generally designated 10, is positioned within the cooling tower interior (not shown) above the fill section (not shown). The system has particular application to counterflow cooling towers where the air-liquid contact system is internal of the tower shell. The distribution pipe 12 utilized in the suspension system 10 is designed to have the characteristics of a beam rather than a pipe, FIGS. 1 and 2. This is achieved by substantial reinforcement of the pipe in the longitudinal direction as described hereinafter.

Figure 2:
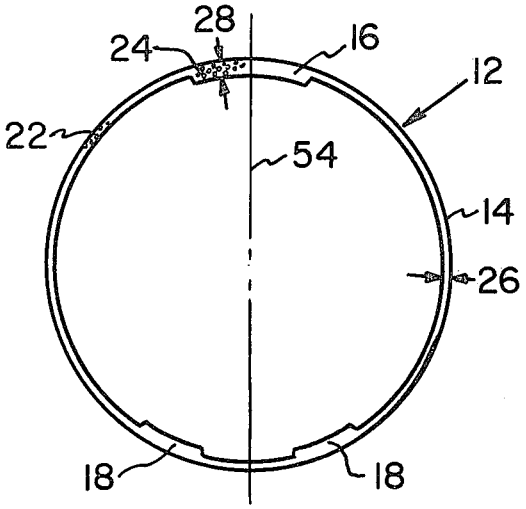
FIG. 2 is a section through the distribution pipe.

The pipe 12 is defined by wall 14 having a general wall thickness 26, FIG. 2. Extending along the interior of the wall 14 throughout its length are upper reinforcing rib 16 and lower reinforcing ribs 18. While the ribs are preferably positioned along the interior of the wall, they may also extend along the outer wall surface, although the latter configuration disrupts the contour of the pipe and could affect its ultimate suspension. These ribs 16 and 18 are formed integral with the pipe wall 14 and formed by an increased wall thickness 28. The wall 14 and the ribs 16 and 18 are reinforced by a plurality of longitudinally extending glass fibers 22 and 24, respectively. The wall thickness 28 of the ribs 16 and 18 is approximately twice the thickness 26 of the pipe wall 14. A typical pipe 10 will have an inside diameter of 14 inches and a wall thickness of $\frac{1}{8}$ of an inch. The rib thickness will then be on the order of a quarter of an inch. The flexure modulus for the ribs is on the order of five million, whereas the balance of the wall of the pipe approaches two million. The percentage of longitudinally extending glass fibers in each rib is on the order of twice the amount as in the remaining wall.

The upper rib 16 extends longitudinally along the pipe 12 and is centered on the vertical center line 54 of the pipe 12 which is mounted in a horizontal position. The bottom ribs 18 extend in parallel and spaced relationship to each other and longitudinally of the pipe on either side of the vertical center line 54. The two bottom ribs 18 each have a rib width approximately equal to one-half of the rib width of the upper rib 16. For a 14 inch I.D. pipe, the upper rib 16 will have a width of four inches with each lower rib 18 having a width of two inches. The lower ribs 18 are spaced from each other by about three and one-half inches. The purpose for the spacing between the lower ribs 18 is to accommodate the openings 20 which are spaced along the bottommost part of the pipe along the vertical center line. Openings 20 accommodate the nozzles (not shown) for providing the spray on the fill, see FIG. 1. It will be recognized that a single bottom rib may be employed but this would necessitate forming the openings therethrough.

The pipe can be formed on a hollow profile pultrusion process whereby a fiberglass mat is fed through a polyester resin pan and into forming dies with an appropriate cylindrical mandrel. The fiberglass roving which is also fed through a resin pan is then fed into a second forming die along with the fiberglass mat so as to run longitudinally thereof. Thereafter, a second fiberglass mat is fed through a third die to sandwich the longitudinally extending fiberglass roving therebetween prior to passing through the curing die.

Figure 4:
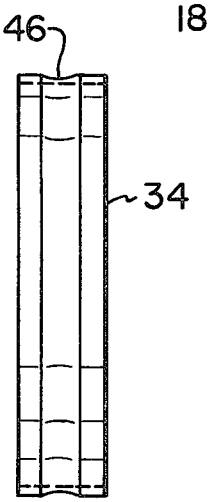
FIG. 4 is a front elevation of an external stiffener ring.

The resultant pipe 12, which has the characteristics of a beam, can be suspended from a horizontal network of concrete beams 30 positioned within the cooling tower on vertical structural members (not shown). External fiberglass reinforced polyester stiffener rings 34 are positioned in intimate contact about the pipe 12 in the area of the pipe suspension, FIGS. 1 and 4. These rings 34 provide the necessary hoop strength to minimize the ovality of the pipe. Specifically, two such stiffener rings 34 are positioned about the pipe 12 in spaced relationship to each other by a distance substantially equivalent to the width of the beam 30 from which the pipe is suspended, FIG. 1.

Figure 1:
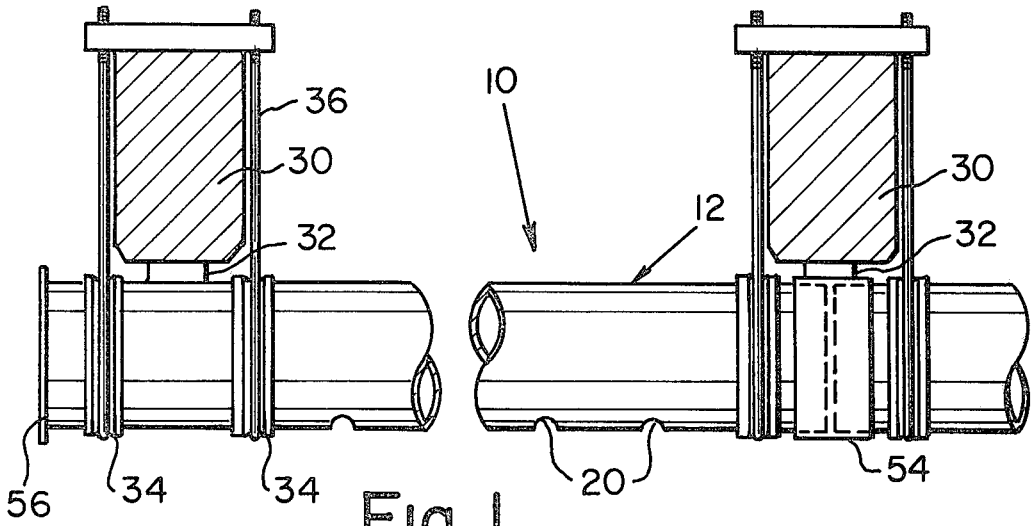
FIG. 1 is a front elevation showing the distribution pipe and suspension system therefor.
Figure 3:
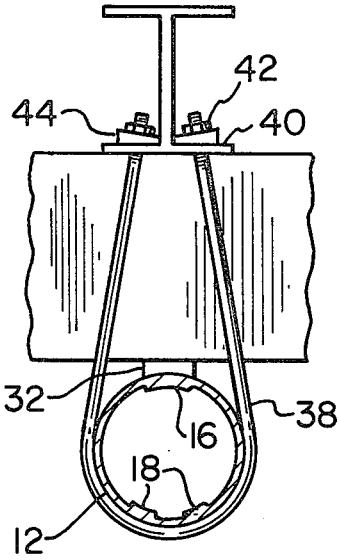
FIG. 3 is a side elevation partly in section of the pipe and system of FIG. 1.

The pipe is typically suspended by means of cables 36, FIGS. 1 and 3. These cables are preferably stainless steel and have a diameter of ⅛ inch or greater. Two such cables 36 are employed in conjunction with each concrete beam 30. The cables 36 extend about the beam so as to form a loop 38 along the beam underside, which loop 38 accommodates the pipe 16. The stainless steel cables extend about the pipe and beam and are threaded at their distal ends. The cable 36 extends through an appropriate support such as I beam 40 positioned atop the beam 30 and accommodates nut 42 and appropriate bearing washer 44.

The pipe 12 is supported on 17 foot centers whereas heretofore it was necessary to span a distance no greater than 13 feet. A pipe coupler 54 can be employed to join successive lengths of pipe. An end cap 56 can be factory installed at one end of the pipe 12. The other end of the pipe extends into a water trough (not shown) which water trough is positioned above the horizontal center line of the pipe so as to gravity feed water up to 2 lbs./sq. inch pressure.

A series of tests have been conducted on a 14 inch I.D. pipe suspended across a 17 foot span. These tests were conducted to determine the beam deflection, long term deflection and ovality of the pipe. The results were as follows. All deflection results were half the allowable deflection.

| Loads | Deflection | Ovality |
|---|---|---|
| Pipe full of 130° F. water | ¼" | ⅛" |
| Water + 4 lbs./ft. uniform load | ¼" | ⅛" |
| Water + 8 lbs./ft. uniform load | ¼" | ⅛" (representative of actual load in cooling tower) |
| The load was then increased to find the maximum load that can be put on the pipe. | | |
| Water + 25 lbs./ft. | 11/32" | ⅛" |
| Water + 50 lbs./ft. | 7/16" | 5/16" |
| Water + 100 lbs./ft. | ½" | 9/16" |
| Water + 150 lbs./ft. | ⅝" | 11/16" |

There was no damage to the pipe at 150 lbs./ft. uniform load over the pipe. The allowable deflection is ½ inch on a 17 foot span and the ovality is 0.140 inch.

Pipe made in accordance with our invention possess the physical characteristics of a beam. The average mechanical properties of a fiberglass reinforced polyester distribution pipe in the as molded condition are:

Longitudinal tensile strength—25,000 psi
Transverse flexural strength—10,000 psi
Longitudinal flexural modulus
0.125 pipe wall: $1.6\times10^6$ psi
0.256 combined wall and rib: $3.0\times10^6$ psi
Coefficient of thermal expansion—$14\times10^{-6}$ ln/ln/°F.

The suspension system and longer span provides up to 23% more open area for air passage.

We claim:

1. In a counterflow cooling tower including structural supports for a water distribution pipe, the improvement comprising:

A. a plurality of spaced horizontal concrete beam structural supports;

B. a distribution pipe formed of fiberglass reinforced polyester resin having longitudinal reinforcing integral ribs formed of an increased wall thickness extending along an interior surface of the pipe throughout the length thereof, one such rib positioned along the pipe top and at least one such rib positioned along the pipe bottom;

C. external ring stiffeners positioned about the pipe and spaced at the same intervals as the structural supports; and D. a suspension system extending about the supports and the external ring stiffeners to suspend the pipe transverse of and below the supports, said suspension system including groups of two lengths of stainless steel cable extending about the pipe, each cable connected above the supports and forming loops below the support, each loop extending about a ring stiffener, and bearing pads positioned between the beams and pipes, said pipe having an end cap at one end and secured within a water trough at its opposite end.

2. The improvement of claim 1, including two ribs extending along the bottom of the pipe, said two ribs positioned in parallel and spaced relationship on opposite sides of the vertical center line.

3. The improvement of claim 1, each of said ribs having approximately twice the amount of glass fibers in the rib as the wall and a flexure modulus at least two and preferably two and one-half times the remainder of the wall of the pipe.

* * * * *